US012601116B2

(12) United States Patent
Spengler

(10) Patent No.: US 12,601,116 B2
(45) Date of Patent: Apr. 14, 2026

(54) METHOD AND DEVICE FOR PRODUCING OR TREATING A WEB OF FIBROUS MATERIAL

(71) Applicant: Voith Patent GmbH, Heidenheim (DE)

(72) Inventor: Julia Spengler, Ulm (DE)

(73) Assignee: Voith Patent GmbH, Heidenheim (DE)

( * ) Notice: Subject to any disclaimer, the term of this patent is extended or adjusted under 35 U.S.C. 154(b) by 147 days.

(21) Appl. No.: 18/515,716

(22) Filed: Nov. 21, 2023

(65) Prior Publication Data

US 2024/0084509 A1 Mar. 14, 2024

Related U.S. Application Data

(63) Continuation of application No. PCT/EP2022/059761, filed on Apr. 12, 2022.

(30) Foreign Application Priority Data

May 28, 2021 (DE) ..... 10 2021 113 813.2

(51) Int. Cl.
*D21F 9/02* (2006.01)
*D21F 7/00* (2006.01)
(Continued)

(52) U.S. Cl.
CPC ..... *D21G 1/0253* (2013.01); *D21F 7/008* (2013.01); *D21F 9/02* (2013.01); *D21F 11/04* (2013.01); *D21G 1/006* (2013.01); *D21G 9/0045* (2013.01)

(58) Field of Classification Search
CPC ..... D21F 9/02
(Continued)

(56) References Cited

U.S. PATENT DOCUMENTS 1,989,037 A * 1/1935 Brown ..... G01B 7/107 324/231
2,436,560 A * 2/1948 Feather ..... B26B 13/28 30/266
(Continued)

FOREIGN PATENT DOCUMENTS

DE 298 18 437 U1 2/1999
DE 10 2017 106 047 A1 3/2018
(Continued)

OTHER PUBLICATIONS

Peel, JD et al. "Kalandrieren Bei Rohen Temperaturen" /PW International Paper World, DPW Verlagsgesellschaft MBH, Heusenstamm, De, vol. 44, No. 10A, (Oct. 1, 1990), pp. VI86-VI93 ISSN: 0031-1340, XP000164656 page VI91 (8 pages).
(Continued)

*Primary Examiner* — Jacob T Minskey
(74) *Attorney, Agent, or Firm* — TAYLOR & EDELSTEIN, PC

(57) ABSTRACT

A process for the production or treatment of a fibrous web, in particular a paper or cardboard web, includes the following steps: a. drying of the fibrous web in a dryer section; b. subsequent cooling of at least one first side of the fibrous web by way of convection cooling, whereby the fibrous web has a temperature of 65° C. or less on at least the first side after cooling, in particular 50° C. and less; c. apply steam to at least the first side of the fibrous web, in particular the temperature on the first side after steam application is at least 70° C., optionally more than 80° C. or 90° C.; and d. treatment of the fibrous web in at least one calendering nip.

20 Claims, 2 Drawing Sheets

(51) Int. Cl.

| | |
|---|---|
| ***D21F 11/04*** | (2006.01) |
| ***D21G 1/00*** | (2006.01) |
| ***D21G 1/02*** | (2006.01) |
| ***D21G 9/00*** | (2006.01) |

(58) Field of Classification Search
USPC ..... 162/123
See application file for complete search history.

(56) References Cited

U.S. PATENT DOCUMENTS

| | | | | |
|---|---|---|---|---|
| 6,073,549 | A * | 6/2000 | Winheim | D21G 1/0093 162/207 |
| 6,332,953 | B1 * | 12/2001 | Singh | D21G 1/006 162/137 |
| 2002/0098317 | A1 * | 7/2002 | Jaschinski | C08B 15/02 428/72 |

FOREIGN PATENT DOCUMENTS

| | | | |
|---|---|---|---|
| DE | 10 2018 106 322 | A1 | 9/2019 |
| EP | 0 957 202 | A2 | 11/1999 |
| EP | 2 682 520 | A1 | 1/2014 |
| WO | 2018/141727 | A1 | 8/2018 |
| WO | 2018/171959 | A1 | 9/2018 |

OTHER PUBLICATIONS

Notification of the Transmission of the International Search Report and Written Opinion of the International Search Authority or Declaration dated Aug. 16, 2022 for International Application No. PCT/EP2022/059761 (11 pages).

* cited by examiner

METHOD AND DEVICE FOR PRODUCING OR TREATING A WEB OF FIBROUS MATERIAL

CROSS REFERENCE TO RELATED APPLICATIONS

This is a continuation of PCT application no. PCT/EP2022/059761, entitled "METHOD AND DEVICE", filed Apr. 12, 2022, which is incorporated herein by reference. PCT/EP2022/059761 claims priority to German patent application no. 10 2021 113 813.2, filed May 28, 2021, which is incorporated herein by reference.

BACKGROUND OF THE INVENTION

1. Field of the Invention

The present invention relates to producing or treating a web of fibrous material.

2. Description of the Related Art

In the production of fibrous webs, a multitude of quality requirements are placed on the end product. Paper, cardboard or packaging webs require for example a sufficiently good surface smoothness in order to ensure good printability or stable application of coatings. For this purpose, one or more calender nips are usually used, in which the fibrous web is smoothed by use of pressure and heat.

On the other hand, these products also require a comparatively high mechanical stability in order to enable safe processing or to give the finished end product—for example, packaging material—the necessary strength. This strength increases with the thickness of the fibrous web.

It is recognized that these two objectives are contradictory in that an improvement in smoothness through greater calendering is associated with compression of the web, and as a result, a reduction in strength.

The easiest way to increase the volume or thickness of the fibrous web would be to use more fiber material. Since fibers, especially cellulose fibers, represent a major cost factor, this is usually ruled out for economic reasons.

It would therefore be very advantageous to have available an option of smoothing the fibrous web in a manner that is protective of the volume.

For this purpose, European patent specification EP 2.682.520 B1 proposes cooling the fibrous web. To achieve this, a humidification device is arranged in conjunction with a cooling device in order to generate moisture evaporation from the fibrous web with a latent thermal cooling effect. The colder web is less easily deformable so that it is not as heavily compressed in the calender nip. However, the disadvantage of the solution described in EP 2.682.520 B1 is that cooling the web makes smoothing more difficult. In extreme cases, it is conceivable that, in order to achieve the desired smoothness, the calender load must be increased to such an extent that the stability advantage gained by cooling is lost in whole or in part.

What is needed in the art is to further develop the state of the art in such a way that simple smoothing of the web is possible while protecting its thickness as far as possible.

What is also needed in the art is to enable volume-protective smoothing with simple and cost-effective ways.

SUMMARY OF THE INVENTION

Explanatory Comments:

Unless explicitly stated otherwise, the terms "fibrous web" and "web" are used synonymously in the following description.

In the following description, the term convection cooling is used. Within the scope of this application, convection cooling is to be understood as cooling by way of air flow. Both passive cooling and active cooling are therein conceivable.

In passive cooling, the fibrous web is guided over a certain distance through ambient air, freely or occasionally supported by rolls, and is thereby cooled. This method of cooling is inexpensive; however, the cooling effect is rather low, and passive cooling requires a comparatively large amount of space to achieve a sufficient cooling effect.

In active cooling, air is blown from suitable nozzle devices onto one or both sides of the web. Higher investments are in fact required for an active convection cooler compared to passive cooling; however, the cooling capacity is significantly higher and can be adjusted more precisely, and the system can be built much more compactly.

Regarding the method, the present invention provides a method for the production or treatment of a fibrous web, in particular a paper or cardboard web, including the following steps:

a. drying of the fibrous web in a drying section;
b. subsequent cooling of at least one first side of the fibrous web by ways of convection cooling, wherein the fibrous web after cooling has a temperature of 65° C. or less, optionally 50° C. or less on at least the first side;
c. application of steam onto at least the first side of the fibrous web, wherein the temperature, in particular on the first side following steam application is at least 70° C., optionally more than 80° C. or 90° C.; and
d. treatment of the fibrous web in at least one calendering nip.

After drying the fibrous web (step a), the fibrous web is very hot. Temperatures of up to 120° C. are possible. Temperatures of 60° C. or less are hardly measured directly after the drying section. Values between 70° C. and 110° C. are common, in particular 80° C., 90° C. or 100° C.

On leaving the dryer section the fibrous web can have a moisture content of between 6% and 12%, in particular between 7% and 8%.

However, due to the high web temperature, the web is relatively soft, so that on a direct pass through a calendering nip significant compression of the web would occur. Therefore, in the present method, the fibrous web is also cooled subsequent to the drying section.

In contrast to the state of the art, the central idea of the current invention is a combined temperature gradient and moisture gradient smoothing. The web, which is very hot and very dry following the drying section, should be conditioned before entering the calendering nip in such a way that the web—in its interior—is as cold and dry as possible, whereas it is moist and warm on at least its first side, or on both sides in the surface region.

The moist and warm surface is then sufficiently soft and malleable so that the desired smoothness can easily be created in the calendering nip. However, since the core of the web is comparatively cold, the compressibility in this area remains low, so that the thickness remains largely intact in the calendering nip. The moisture gradient, in other words, the fact that the web interior is also very dry when running into the calendering nip, on the one hand also supports preservation of the thickness. In addition, it is of course also advantageous not to add too much new moisture to the already dry web, as this would have to be removed again from the web in an elaborate process following the calendering nip.

The necessary conditioning of the web is accomplished by two surprisingly simple and inexpensive process steps.

First, the web is cooled after the drying section by way of convection cooling, on at least one first side, optionally on both sides. Cooling with air reduces the web temperature and keeps the web dry, in contrast to cooling by way of applying water.

It is herein very advantageous if there is no moistening of the fibrous web between leaving the dryer section and cooling in step b).

Subsequently, the web is supplied on at least one side, in particular on both sides with steam. The steam can also be a steam-air mixture. The steam condenses on the cool surface of the fibrous web, as a result of which the web warms on the surface, as well as being moistened. On its interior however, the web remains relatively cool and dry.

In order to enable good condensation of the steam, a relatively low surface temperature of the fibrous web is important. The lower the temperature, the better, or the more steam condenses on the surface, and the stronger the moisture or temperature gradient develops. Therefore, even if the web is very hot after the drying section, it is recommended that the web or the surface is cooled to at least 65° C. or less after convection cooling. In advantageous embodiments, the web is cooled to a temperature of less than 60° C., especially less than 55° C. or less than 50° C. and optionally less than 45° C.

When steam is applied to the web, the temperature of the surface increases again. Here it is advantageous if the temperature of the fibrous web on at least the first side is at least 70° C., optionally higher than 80° C. or 90° C., after exposure to steam.

The moisture on the surface also increases as a result. After condensation of the steam on the paper web, the moisture on the surface may be 15% or higher.

With this temperature gradient and moisture gradient, the fibrous web is then fed into a calendering nip where it is treated, in particular smoothed. As described above, the thickness of the web is largely retained during calendering.

If only one side of the web is to be smoothed, it may be sufficient to cool only the first side. However, it will often be advantageous to cool the web from both sides.

Especially when smoothing the web on both sides, it is also advantageous if both sides of the web are treated with steam. In particular, it is also advantageous in this case to cool the web on both sides by way of convection cooling.

Since the temperature of the web slowly decreases again after the steam application, and since the moisture in the web equalizes again over time, passage through the calendering nip should not take place too long after the steam application. The surface temperature of the first side of the fibrous web on entering the calendering nip should be at least 60° C., in particular at least 70° C., optionally between 80° C. and 90° C. It is advantageous herein if the distance between the end of the steam application and the calendering nip is not more than 1 m, in particular 80 cm or less or 50 cm or less. An even shorter distance of for example 30 cm or less would be desirable but will often be difficult to achieve due to structural constraints.

In order to achieve successful smoothing, it is particularly advantageous if at least one calendering nip consists of a heated roll and a counter element, wherein the heated roll has a surface temperature of 220° C. or more and comes into contact with the first side of the fibrous web.

Such heated rolls ("thermal rolls") are usually heated by way of a heating fluid, especially an oil. In order to achieve the desired surface temperatures, it is expedient to supply the heating fluid to the heated roll at a temperature of at least 240° C., optionally between 260° C. and 310° C. In order to achieve temperatures of well over 310° C., special thermal oils are necessary. However, these are usually difficult to handle and usually toxic. Another advantage of the current invention is that the temperature and moisture gradients in the web facilitate good smoothing to be achieved without the need for extremely high temperatures in the heating roll, which makes it possible to dispense with these toxic special oils.

The effective surface temperatures that can be achieved during operation with a heating fluid, especially with fluid temperatures of up to 310° C., also depend on how much heat energy is dissipated with the fibrous web. In general, more heat is dissipated in the calendering nip at higher linear loads and higher production speeds. In order to enable sufficiently high surface temperatures on the heated roll even in such applications, it is advantageous if the heated roll has a large diameter. The roll diameter can thereby be greater than 1 m, especially 1.50 m or 1.60 m.

In most cases, surface temperatures of higher than 200° C. and particularly higher than 220° C. can be achieved via the heating fluid. However, it could become difficult to achieve temperatures of higher than 240° C.

Therefore, the heated roll can be additionally heated by a heating bar which is directed against the thermal roll from the outside and which heats the roll by way of induction or a temperature-controlled air flow.

As a result, the roll surface can be heated stably and reliably to temperatures above 220° C., optionally in the range between 230° C. and 250° C.

The at least one calendering nip can be operated advantageously at a maximum linear load of 150 N/mm, in particular less than 100 N/mm, optionally at a linear load between 10 N/mm and 40 N/mm. Here, too, it has been shown that due to the temperature and moisture gradients in the web good smoothing can be achieved, even at low linear loads. By reducing the linear load, the compression of the web and thus the loss of thickness are also reduced.

The fibrous web can basically be any paper or cardboard web. In particular, it can be a cardboard web consisting of 2 or more layers and having a basis weight between 100 g/m$^2$ and 600 g/m$^2$, in particular between 150 g/m$^2$ and 450 g/m$^2$. Such heavy and thick fibrous webs are particularly well suited for treatment according to one aspect of the current invention. Due to the high thickness or the large mass in the interior of the web, the coolness and dry content of these webs are particularly well preserved when the surface is heated and moistened by condensation of the steam. The moisture and temperature gradients are therefore particularly pronounced in these thick or heavy varieties.

The method can be carried out in a wide range of speeds. For example, provision may be made for the fibrous web to move at a speed between 600 m/min and 1600 m/min, in particular between 800 m/min and 1400 m/min. In particular at slower speeds of 800 m/min or less, passive convection cooling can be advantageous, as the distance required for cooling will not be too great due to the lower speed. In contrast, especially at speeds of 800 m/min and higher, the provision of an active convection cooler is advantageous in order to avoid excessive sizes. For this reason, it can also be advantageous to use the free-distance installation space in an existing passive convection cooling system in order to provide an active convection cooler there, which can establish the possibility of higher operating speeds.

Usually, in the case of paper or board machines, a press section is provided before the drying section. In the press section, the fibrous web is dewatered by mechanical compression. In most cases, the web is passed between two felts through one or more press nips.

For applications within the scope of the current invention, it has proved to be advantageous if at least the last press nip before the dryer section is designed as a wet press. The fibrous web runs thereby through the press either supported only on a felt ("laying press") or completely without felt ("offset press"). Thus, at least one side of the fibrous web (or both sides, as in the case of the offset press) has direct contact with the smooth press roll. It is herein particularly advantageous if at least the first side of the fibrous web is in direct contact with the smooth press roll, onto which steam is applied later. It has been shown that by using such a wet press, a more volume-protective smoothing can be achieved, because the fibrous web exits the dryer section smoother, thus less smoothing has to be achieved in the calender.

Often, only a small amount of dewatering of the web is achieved by the wet press. For example, the dry content only increases by less than 2 percentage points, in particular by 1 percentage point or less.

In order to ensure a sufficiently dry fibrous web after the press section, provision may be made that the fibrous web is dewatered before the wet press by at least one, optionally two double-felted shoe presses.

The wet press itself can be designed as a roll press or as a single-felted shoe press.

Alternatively, or in addition it may be provided that the calender in at least one calendering nip has ways to calibrate thickness in order to adjust the thickness of the fibrous web across the web width.

The calibration ways may for example be thermal calibration. Herein, a calender roll, the thermal roll or the counter roll, is provided with a temperature profile across its with from the outside. Areas with a higher temperature expand more, which increases the radius of the roll slightly at this point, thereby increasing the pressure in the calendering nip. Thus, a pressure profile can be set in the calendering nip by way of the temperature profile, which in turn influences the thickness profile of the fibrous web.

However, in particular at comparatively high surface temperatures in the calender, for example 220° C. or more, it became evident that thermal calibration is less efficient.

In particular with high surface temperatures in the calender it can therefore be advantageous, if the calibration occurs by way of a so-called deflection control roll. These rolls, which are marketed by the applicant under the name 'NipCo' roll, are equipped in their interior with a series of punches which can deform the roll shell in a targeted manner and thus set a pressure profile.

The deflection control roll is usually not designed as a thermal roll.

An optional calendering nip can then be composed of a thermal roll and a bending adjustment roll as the counter roll.

Regarding the device, the present invention provides a device for the production or treatment of a fibrous web, in particular a paper or cardboard web, wherein the device includes a drying section for drying the fibrous web and a calender having at least one calendering nip for treatment, in particular smoothing, of the fibrous web. According to the present invention, it is provided that—viewed in direction of web travel—the device includes a steam blow box upstream from the calender for applying steam to a first side of the fibrous web, and that between the dryer section and the steam blow box ways for convection cooling are provided which are suitable for cooling at least the first side of the fibrous web by way of convection to a temperature of 65° C. or less, in particular to 50° C. and less.

In advantageous embodiments, it can be provided that the ways of convection cooling are implemented as passive cooling through of a free section of the fibrous web, whereby the length of the free section is at least 5 m, optionally at least 7 m, in particular 10 m or more.

Alternatively, or in addition, the ways of convection cooling may include or consist of active cooling by at least one convection cooler, wherein the convection cooler is designed to blow air onto at least the first side, in particular onto both sides of the fibrous web. Optionally, a certain amount of free space will be provided before and/or after the convection cooler. However, this can usually be designed according to the criteria of favorable web guidance and does not have to make a significant contribution to convection cooling.

Even if only one side of the web is to be smoothed, it can be advantageous to design the convection cooler in such a way that air is blown onto both sides of the web. On the one hand, this leads to more efficient cooling of the web. On the other hand, a more stable web run can be achieved if air is blown from both sides onto the web, either at the same time or at a very short time interval.

In addition, such a convection cooler is very compact. Already with an extension in machine direction of between 1 m and 2 m, for example 1.5 m, a very effective cooling of the web can be achieved. In challenging applications, for example at high web speed and/or high basis weights of the web, the convection cooler can also extend to over 4 m in machine direction, in particular up to 6 m. In such applications, passive cooling is then hardly achievable in a meaningful way, as this would require an extremely long free distance.

In principle, it is also possible to achieve the cooling effect by way of contact cooling instead of convection cooling. In this case, one or more cooling cylinders may for example be provided instead of a convection cooler. The fibrous web can then be passed over these cooling cylinders so that it is in contact with the cooled cylinder surfaces with one or both sides. These cylinder surfaces can be cooled to temperatures below 40° C., especially below 30° C. or 25° C. With this type of cooling, however, there is no material interaction and no breaking through of the air boundary layer at the fibrous web. Therefore, the efficiency of such cooling is comparatively low. In addition, cooling cylinders require a comparatively large installation space and are relatively expensive. Therefore, convection cooling is optional, especially for newly constructed plants.

However, it can definitely be advantageous—for example, when converting a system that already includes a cooling cylinder—to combine convection cooling with contact cooling. Particularly in the case of passive cooling, additional contact cooling from one or both sides of the web may be provided before and/or after a free section.

In optional designs, a convection cooler may have ways for conditioning the air. Conditioning can be accomplished through tempering, optionally by cooling the air. Alternatively, or in addition, conditioning can also be done by humidifying and/or dehumidifying the air. Proper conditioning of the air that is blown onto the web can greatly influence the impact of the convection cooler.

Tests carried out by the applicant showed that surface temperatures between 50° C. and 65° C. could be achieved when cooled by ambient air at temperatures between 30° C. and 45° C. When the ambient air was cooled to temperatures below 30° C.—in particular to 25° C. and lower—in the same experimental set-ups, surface temperatures of 50° C. and lower, in particular 45° C. and lower could be achieved following the cooling device. Temperatures of 40° C. are also possible.

Usually, a measuring device such as a scanner can be provided following the calender. This makes it possible, for example, to measure the properties of the fibrous web, such as thickness or gloss. Using these measurements, it is then possible to control or regulate the amount and/or temperature and/or moisture content of the applied air in the active convection cooler.

After the calender, in particular after the scanner, the web can then be rewound. Alternatively, provision can also be made that further process steps follow after the calender. For example, one or more coating units may be provided.

Provisions are often made that at least one calender nip consists of a heated roll and a counter element, whereby the heated roll can be heated to a surface temperature of 220° C. or more and is arranged in such a way that it comes into contact with the first side of the fibrous web.

The counter element can advantageously be designed as a bending compensation roll. For example, this makes profiling of the calender possible.

The diameter of the heated roll and/or the bending compensation roll can be between 400 mm and 1600 mm respectively.

The diameters of the two rolls can be the same. However, it may also be provided that the diameter of the bending compensation roll deviates from the diameter of the heated roll by a maximum of 50%, optionally a maximum of 40%. In most cases, the bending compensation roll then has a smaller diameter than the heated roll.

The calendering nip can be formed as a hard nip or as a soft nip. In particular, one or both rolls of the calendering nip can have a hardness of 60° ShoreD to 98° ShoreD, optionally between 88 and 92° ShoreD.

One or both rolls of the calender may, for example be composite rolls.

The calendering nip can consist of a roll nip. Alternatively, the calendering nip can also be an extended nip, such as in a shoe calender or a ribbon calender.

A second steam blow box can also be provided for applying steam onto the second side of the fibrous web. When using an active convection cooler, this is advantageously located between the convection cooler and the calendering nip.

As already described within the framework of the method, it is advantageous if the distance between the end of the steam application in the steam blow box and/or the second steam blow box and the calendering nip is not more than 1 m, in particular 80 cm or less or 50 cm or less. An even shorter distance of for example 30 cm or less would be desirable, but will often be difficult to achieve due to structural constraints.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
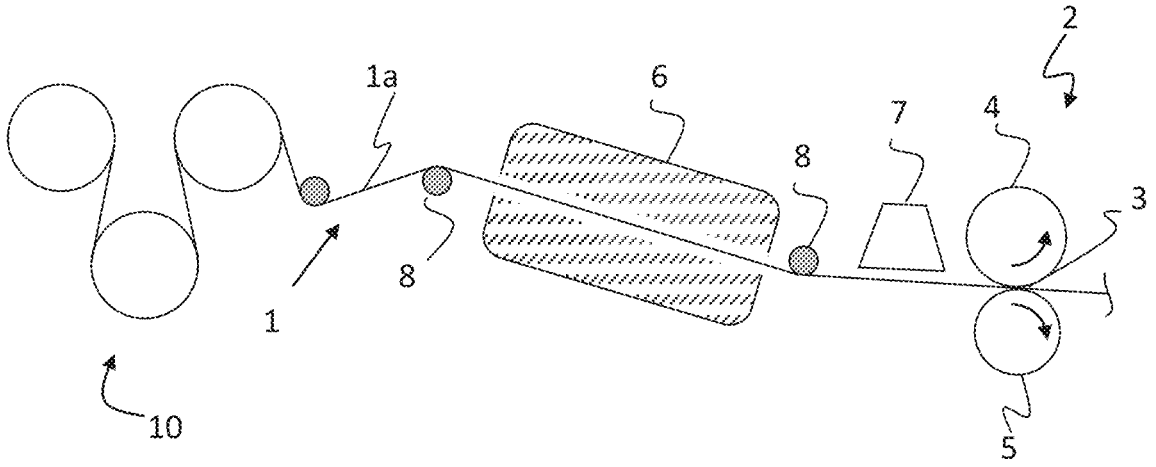
FIG. 1 shows a device according to one aspect of the current invention.

FIG. 1 shows a device according to one aspect of the present invention which is suitable for carrying out a method according to the present invention. A drying section 10 is provided in which a fibrous web 1, such as a paper or cardboard web 1, is dried. Web 1 exits drying section 10 with a low residual moisture of usually less than 12%, for example 7% or 8%, and a high temperature, for example between 75° C. and 90° C.

For further processing of web 1, a calender 2 is provided in FIG. 1. In this example, calender 2 is shown as roll calender 2, equipped with a heating roll 4 and a counter roll 5, which together form calendering nip 3. Heating roll 4 can have a surface temperature of 220° C. or more and is in contact with first side 1*a* of fibrous web 1. Counter roll 5 can be designed as a bending compensation roll. However, any other type of calender can also be provided, such as shoe or ribbon calenders that have an extended calendering nip 3. Usually, a measuring device such as a scanner can also be provided following calender 2. After calender 2, especially after the scanner, web 1 can then be wound rewound. Alternatively, provision can also be made for further process steps to follow after calender 2. For example, one or more coating units may be provided.

In order to achieve the desired volume-protective smoothing, way 6 is provided for convection cooling of web 1 following the drying section. In the design shown in FIG. 1, web 1 is guided via guide rolls 8 to a convection cooler 6, in which it can be actively cooled. For this purpose, air is blown at least onto first side 1*a* of web 1, especially onto both sides of web 1. Even if only one side of web 1 is to be smoothed, it can be advantageous to design convection cooler 6 in such a way that air is blown onto both sides of web 1. On the one hand, this leads to more efficient cooling of web 1. On the other hand, a more stable web travel can be achieved if air is blown simultaneously or at very short time intervals onto both sides of web 1.

This air can be taken directly from the environment, for example, from a cooler region of the production line such as the machine basement; or it can be conditioned prior to applying it onto fibrous web 1. In particular, cooling of the air, for example by way of a suitable heat exchanger, is advantageous, as this can significantly improve the cooling effect of convection cooler 6, so that a much lower web temperature can be achieved following convection cooler 6.

Following convection cooling, web 1 is supplied with steam on at least first side 1*a*. For this purpose, a steam blow box 7 is provided in the device shown. The steam is supposed to condense at web 1 and moisten as well and heat the region near the surface. In order to allow the steam to condense as well as possible, it is advantageous if the web temperature subsequent to the convection cooling ways or before entering steam blow box is 50° C. or less. With active convection coolers 6, the temperature can also be lowered significantly, for example to 45° C. or 40° C.

If both sides of fibrous web 1 are to be treated, in particular smoothed, a second steam blow box may also be provided, which is arranged in such a way that it compresses the second side of the fibrous web with steam.

After leaving the steam blow box 7, web 1—at least on first side 1*a*—has the temperature and moisture gradients that are desired to achieve volume-protective smoothing. Since fibrous web 1 tends to equalize such gradients again over time, it is advantageous to guide web 1 as quickly as possible after steam blow box 7 into calendering nip 3. It is therefore optional to place steam blow box 7 very close to calendering nip 3, so that the distance between steam blow box 7 and calendering nip 3 is a maximum of 1000 mm, in particular a maximum of 500 mm.

Figure 2:
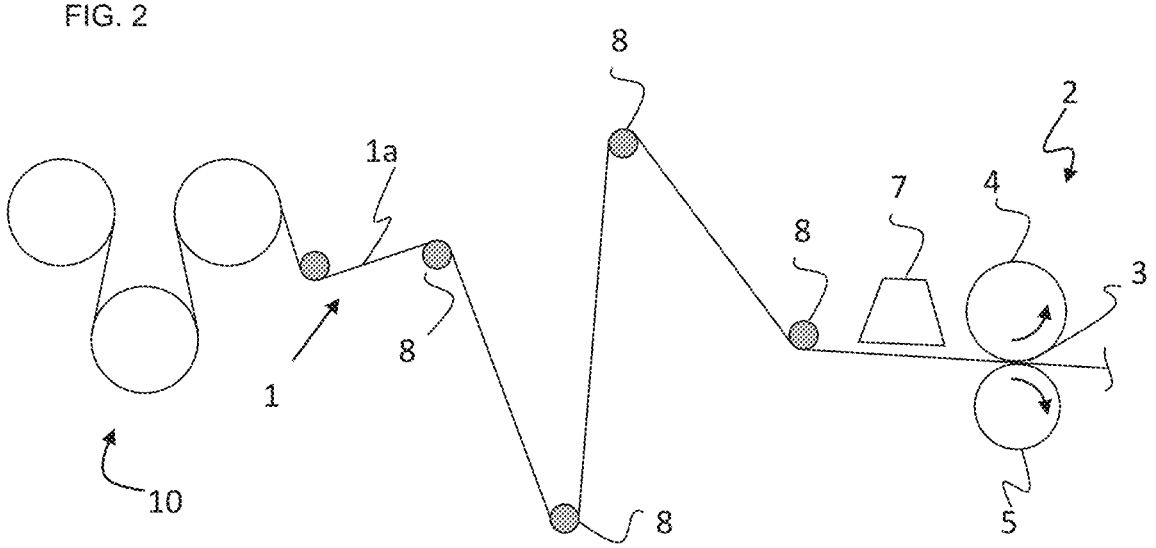
FIG. 2 shows a device according to an additional aspect of the current invention.

The design shown in FIG. 2 differs from that in FIG. 1 only in the design of the ways for convection cooling. Instead of active cooling by way of a convection cooler 6, convection cooling is realized in FIG. 2 as passive cooling by way of a free section of fibrous web 1. To improve cooling of web 1, it is advantageous if the free section is at least 5 m, optionally at least 7 m long. In order to achieve the longest possible free distance, in the design according to FIG. 2, web 1 between drying section 10 and steam blowing box 7 is diverted several times—for example twice, three times, four times or more—by guide rolls 8, so that even with a limited structural length of the device, a sufficient free distance can be provided for the cooling of lane 1.

Figure 3:
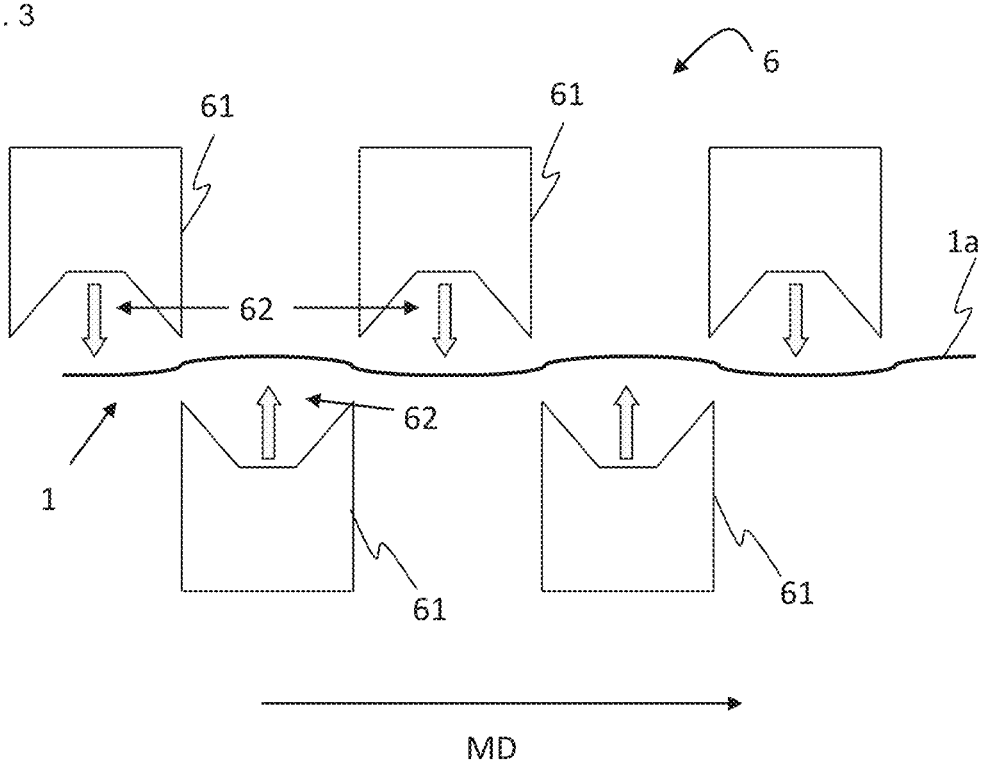
FIG. 3 shows a convection cooler for use in a device according to an additional aspect of the invention.

FIG. 3 shows a schematic section of a convection cooler 6 for active cooling of fibrous web 1, as it can be used, for example, in a design according to FIG. 1. Two rows of nozzles 61 are provided, each of which blow an air flow 62 onto fibrous web 1. Nozzles 61 of the upper row therein supply first side 1*a* of web 1 with an air flow 62; nozzles 61 of the lower row supply the second side. Nozzles 61 extend over the entire width of web 1 (CD-Cross Direction) and are arranged one behind the other in the direction of travel machine direction (MD—Machine Direction). FIG. 3 shows two or three nozzles 61 per row as an example. In practical applications, however, it can also be significantly more, for example 10, 12, 15 or more nozzles per row, in order to achieve the desired cooling of lane 1. It is advantageous to provide a distance between nozzles 61 of each row in the MD direction. The distance, which can correspond in particular to the MD expansion of a nozzle 61, allows a trouble-free discharge of air flow 62 after impinging on web 1.

Regardless, such a convection cooler 6 is very compact. Already with an MD extension between 1 m and 2 m, for example 1.5 m, excellent cooling of the web can be achieved. However, larger MD extensions of up to 4 m, 5 m or 6 m are also possible.

An active convection cooler 6 with two rows of nozzles, as shown here, has the advantage that web 1 is cooled from both sides, allowing for faster cooling. In addition, the web travel of web 1 will also be stabilized. By applying an air flow 62 onto first side 1*a*, the web turns downwards. Air flows 62 from lower nozzles 61 act against this, and guide web 1 back upwards. As a result of alternately depressing and lifting, web 1 travels in a slight wave motion, but essentially stable and straight through convection cooler 6.

The air for air flows 62 can simply be ambient air, which is usually 30° or more in the vicinity of a paper machine and can also be quite humid. Alternatively, the air can also be conditioned, for example cooled to 25° or 20° C. and, if necessary, dehumidified.

COMPONENT IDENTIFICATION LISTING

1 Fibrous web
1*a* first side
2 Calender
3 Calendering nip
4 Heating roll
5 Counter Roll
6 Convection coolers
7 Steam blow box
8 Guide roll
10 Dryer section
61 Nozzle
62 Airflow While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for producing or treating a web of fibrous material, the method comprising the steps of:

drying the web of fibrous material in a drying section;

subsequently cooling at least a first side of the web of fibrous material by way of convection cooling, the web of fibrous material after cooling having a temperature of 65° C. or less on at least the first side;

applying steam onto the at least one first side of the web of fibrous material, the temperature after applying steam being at least 70° C.; and treating the web of fibrous material in a single calendering nip, the calendering nip including a heated roll and a counter element, and a distance between an end of applying steam and the calendering nip being not greater than 1 m, the web of fibrous material running at a speed of between 600 m/min and 1600 m/min.

2. The method according to claim 1, wherein the web of fibrous material is smoothed by way of a wet press prior to the drying section, wherein the web of fibrous material is a paper web or a cardboard web.

3. The method according to claim 1, wherein a surface temperature of the first side of the web of fibrous material on entering the calendering nip is at least 60° C.

4. The method according to claim 1, wherein the heated roll has a surface temperature of 220° C. or more and comes into contact with the first side of the web of fibrous material.

5. The method according to claim 1, wherein the heated roll is heated by way of a heating fluid, wherein the heating fluid is supplied to the heated roll at a temperature of at least 240° C.

6. The method according to claim 1, wherein the calendering nip is operated at a maximum linear load of 150 N/mm.

7. The method according to claim 1, wherein no moistening of the web of fibrous material occurs between leaving the dryer section and the step of subsequently cooling.

8. The method according to claim 1, wherein the web of fibrous material is a cardboard web including at least two layers and having a basis weight between 100 g/m$^2$ and 600 g/m$^2$.

9. The method according to claim 1, wherein the web of fibrous material after cooling having a temperature of 50° C. or less on at least the first side, and wherein the temperature on the first side of the web of fibrous material after applying steam is at least 80° C. or 90° C.

10. A device for producing or treating of a web of fibrous material, the device comprising:

a drying section configured for drying the web of fibrous material;

a calender having a single calendering nip configured for treating the web of fibrous material, the calendaring nip including a heated roll and a counter element, the device being configured for treating the web of fibrous material at a speed of between 600 m/min and 1600 m/min;

a steam blow box positioned—when viewed in a direction of travel of the web of fibrous material—upstream from the calender, the steam blow box being configured for applying steam to a first side of the web of fibrous material; and a convection cooling device positioned between the drying section and the steam blow box, the convection cooling device being configured for cooling at least the first side of the web of fibrous material by way of convection to a temperature of 65° C. or less.

11. The device according to claim 10, wherein the calendaring nip is configured for smoothing the web of fibrous material.

12. The device according to claim 10, wherein the convection cooling device is configured for passive cooling through a free section of the web of fibrous material, wherein a length of the free section is at least 5 m.

13. The device according to claim 10, wherein the convection cooling device includes or consists of a convection cooler configured for active cooling, wherein the convection cooler is configured for blowing air onto at least the first side.

14. The device according to claim 13, wherein the convection cooler is configured for blowing air onto both the first side of the web of fibrous material and a second side of the web of fibrous material.

15. The device according to claim 13, wherein the convection cooler is structured and arranged for conditioning the air.

16. The device according to claim 15, wherein the convection cooler conditions the air by at least one of tempering, humidifying, and dehumidifying the air.

17. The device according to claim 10, wherein the calendering nip includes a heated roll and a counter element, wherein the heated roll is configured for being heated to a surface temperature of 220° C. or more and for coming into contact with the first side of the web of fibrous material.

18. The device according to claim 10, wherein the calender includes a thickness calibration device configured for a calibrating a thickness.

19. The device according to claim 18, wherein the thickness calibration device is implemented by way of at least one of a thermal calibration and a deflection control roll.

20. The device according to claim 10, further comprising an additional steam blow box configured for applying steam onto a second side of the web of fibrous material, and wherein a distance between (a) at least one of the steam blow box and the additional steam blow box and (b) the calendering nip is a maximum of 1000 mm.

* * * * *